US005936653A

United States Patent [19]

Yamaguchi et al.

[11] Patent Number: 5,936,653

[45] Date of Patent: Aug. 10, 1999

[54] THERMAL TRANSFER PRINTING MECHANISM AND FACSIMILE DEVICE

[75] Inventors: Hiroshi Yamaguchi; Takatoshi Takemoto, both of Nagoya; Tatsuji Imai, Ichinomiya, all of Japan

[73] Assignee: Brother Kogyo Kabushiki Kaisha, Aichi-ken, Japan

[21] Appl. No.: 08/654,058

[22] Filed: May 28, 1996

[30] Foreign Application Priority Data

May 25, 1995 [JP] Japan ..... 7-126383

[51] Int. Cl.[6] ..... B41J 35/06; B41J 35/04

[52] U.S. Cl. ..... 347/216; 400/247; 400/248

[58] Field of Search ..... 400/247, 248; 347/216

[56] References Cited

U.S. PATENT DOCUMENTS 5,709,488 1/1998 Imai et al. ..... 400/248

FOREIGN PATENT DOCUMENTS 4-238041 8/1992 Japan .

*Primary Examiner*—Huan Tran

*Attorney, Agent, or Firm*—Kane, Dalsimer, Sullivan, Kurucz, Levy, Eisele and Richard, LLP

[57] ABSTRACT

A thermal transfer printing mechanism for use in a facsimile device includes a separating guide surface that is formed having a curve having a radius of curvature of not more than 1.2 mm. Consequently, the acceleration in a separating direction of an ink film separated from an image receiving sheet by the separating guide surface is increased, and the ink film is smoothly separated from the image receiving sheet. The separating guide surface may be formed as a bent thin plate, an embossed portion, a deformed edge of a supporting member, a plastic attachment, or a plastic tape. The separating guide surface is formed as a curve continuing from a feeding guide surface, and the feeding guide surface bends the sheet and the ink ribbon from a plane connecting a contact line of a thermal head and the ink ribbon and a contact line of the sheet and a sheet guide member provided downstream of the separating guide surface.

18 Claims, 9 Drawing Sheets

THERMAL TRANSFER PRINTING MECHANISM AND FACSIMILE DEVICE

BACKGROUND OF THE INVENTION

The present invention relates to a thermal transfer printing mechanism using an ink ribbon to form an image on image receiving sheet, and a facsimile device employing the mechanism. As shown in FIGS. 1 and 2, a conventional thermal transfer printing mechanism comprises, for example, a line type thermal head 11, a platen roller 13 for supporting the sheet 12 against the thermal head 11, and an ink ribbon 14 fed between the thermal head 11 and the sheet 12.

The thermal head 11 includes a heating array 15 comprising many heating elements arranged in the main scanning direction (i.e., the direction of sheet width). The heating elements heat the ink carried by the ink ribbon, so that the ink is melted and transferred to the sheet 12 according to the pattern of heated elements. The ink ribbon 14 tends to adhere to the sheet because of the melting or melted ink.

Usually, a guide member 16 is provided downstream of the thermal head 11 to separate the ink ribbon 14 from the sheet 12. The guide member 16 has a curve 16*a* around which the ink ribbon 14 is bent, to change the direction of the ink ribbon 14 as it is fed. The radius of curvature of the curve 16*a* is relatively large so that the ink ribbon 14 is fed smoothly.

However, as shown in FIG. 2, when one or more lateral lines L are printed on the sheet 12, the ink ribbon 14 adheres to the sheet at the lateral line L, but does not adhere to the sheet in the spaces between the lines L. Consequently, as shown in FIG. 3A, the ink ribbon 14 may remain adhered to the sheet 12 after passing the curve 16*a*, and may abruptly separate from the sheet 12 (as shown in FIG. 3B). This type of abrupt separation of the ink ribbon 14 generates vibration and noise. Accordingly, if such a conventional thermal transfer printing mechanism is employed in a facsimile device, the generated noise during operation can become unacceptable.

SUMMARY OF THE INVENTION

It is therefore an object of the present invention to provide an improved thermal transfer printing mechanism that stabilizes the separation of the ink ribbon and sheet, and an improved facsimile device having a thermal transfer printing mechanism that stabilizes the separation of the ink ribbon and sheet.

In order to meet these objects, according to one aspect of the present invention, a thermal transfer printing mechanism for forming an image on an image receiving sheet using an ink ribbon includes: a thermal line print head arranged along a sheet feeding path; a platen roller for pressing the ink ribbon and the image receiving sheet together and against the thermal line print head; a feeding guide surface downstream of the thermal line printhead along the sheet feeding path, for contacting a surface of the ink ribbon and guiding the ink ribbon; and a separating guide surface downstream of the feeding guide surface along the sheet feeding path, for separating the ink ribbon from the image receiving sheet, the separating guide surface formed as a curve continuing from the feeding guide surface and having a radius of curvature of not more than 1.2 mm.

According to another aspect of the present invention, a facsimile device, having an image reading apparatus and an image forming apparatus for forming an image on an image receiving sheet using an ink ribbon, includes: a thermal transfer printing mechanism includes: a thermal line print head arranged along a sheet feeding path; a platen roller for pressing the ink ribbon and the image receiving sheet together and against the thermal line print head; a feeding guide surface downstream of the thermal line printhead along the sheet feeding path, for contacting a surface of the ink ribbon and guiding the ink ribbon; and a separating guide surface downstream of the feeding guide surface along the sheet feeding path, for separating the ink ribbon from the image receiving sheet, the separating guide surface formed as a curve continuing from the feeding guide surface and having a radius of curvature of not more than 1.2 mm.

According to these aspects of the present invention, when the ink ribbon is separated from the image receiving sheet by the separating guide surface, the small radius of curvature to ensures that the acceleration of the movement of the ink ribbon in the separating direction is large, and the ink ribbon and sheet are smoothly separated because of the large separating force. In a preferred embodiment, the separating guide surface is formed as a curve having a radius of curvature from 0.4 mm to 1.0 mm.

According to one particular development of these aspects of the invention, the thermal transfer printing mechanism further includes a sheet guide member provided downstream of the separating guide surface and contacting the image receiving sheet, and the feeding guide surface bends the sheet and the ink ribbon from a plane connecting a contact line of the thermal head and the ink ribbon and a contact line of the sheet guide member and the sheet. In this manner, the separating guide surface is the last member to contact the sheet and ink ribbon as they are separated, and smooth separation is ensured as previously described.

According to another particular development of the invention, the thermal transfer printing mechanism includes a supporting member that supports the separating guide surface, and the separating guide surface is formed as a bend in a resilient plate having a thickness of approximately 0.2 mm. The resilient plate is bent to have a mouth portion formed therein, and a width of the mouth portion is smaller than a length of the supporting member in a feeding direction of the sheet feeding path. In one preferred embodiment, the resilient plate is clipped to the supporting member via the mouth portion and spot welded to the supporting member. In another preferred embodiment, the resilient plate is clipped to the supporting member via the mouth portion and adhered to the supporting member via double-sided adhesive tape. Accordingly, the resilient plate is easily assembled and secured to the supporting member.

According to still another particular development of the invention, the thermal transfer printing mechanism includes a supporting member that supports the separating guide surface, wherein the separating guide surface is formed as an embossed portion of the supporting member. Accordingly, the number of parts is low, reducing the cost of the printing mechanism.

According to yet another particular development of the invention, the thermal transfer printing mechanism includes a supporting member that supports the separating guide surface, wherein the separating guide surface is formed as a deformed edge of the supporting member at the most downstream portion of the supporting member. Consequently, the number of parts is low, reducing the cost of the printing mechanism.

According to yet still another particular development of the invention, the thermal transfer printing mechanism includes a supporting member that supports the separating guide surface, wherein the separating guide surface is formed as a resin plastic plate secured to the supporting member. In this manner, friction and resistance to sliding is reduced, allowing smooth ribbon feeding.

According to a further particular development of the invention, the thermal transfer printing mechanism includes a supporting member that supports the separating guide surface, wherein the separating guide surface is formed as a resin plastic tape adhered to the supporting member. Accordingly, the structure is simple and the assembly easy.

DETAILED DESCRIPTION OF THE PREFERRED EMBODIMENTS

Figure 1:
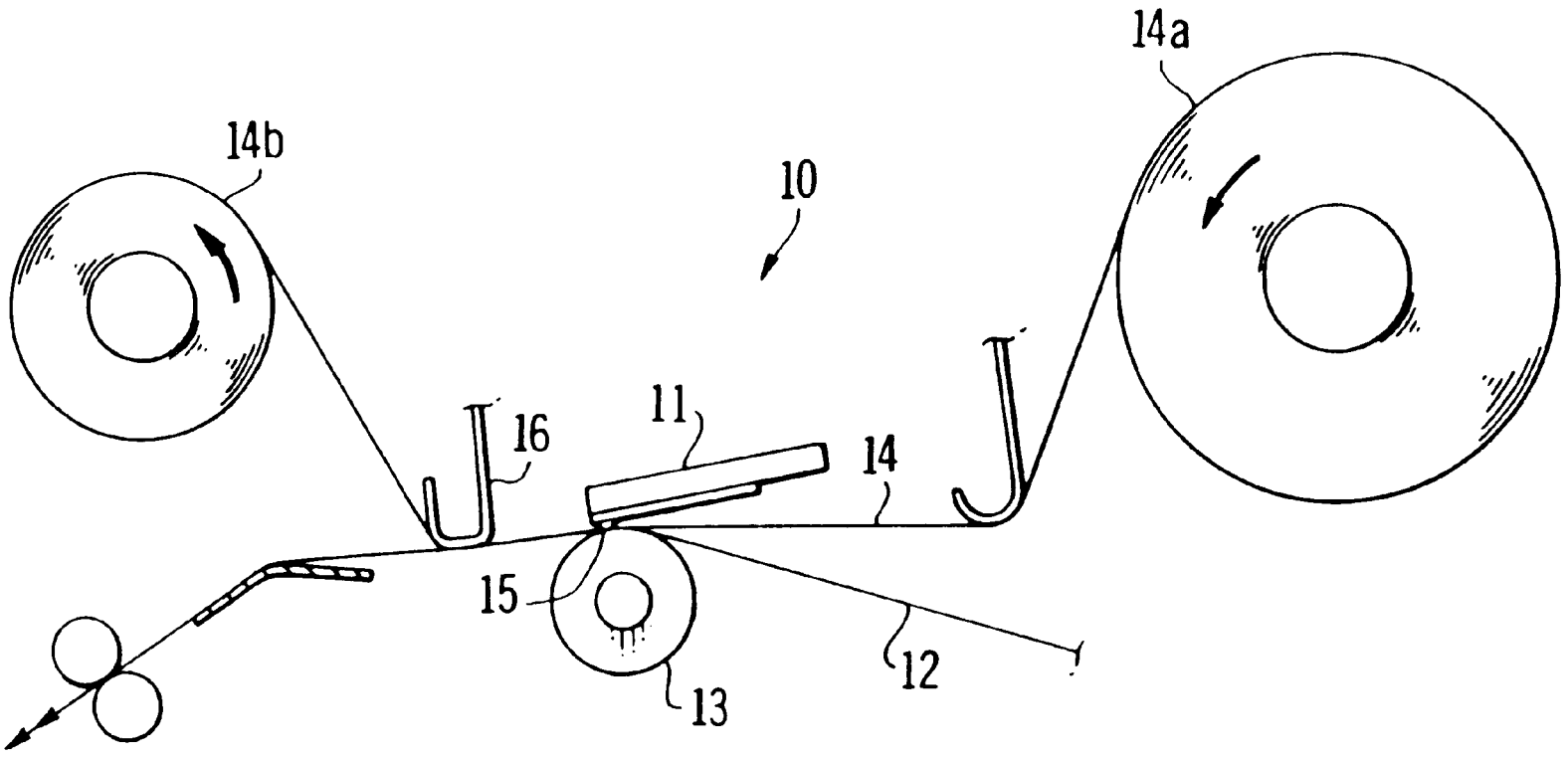
FIG. 1 PRIOR ART
FIG. 1 is a schematic side view of a conventional thermal transfer printing mechanism.
Figure 2:
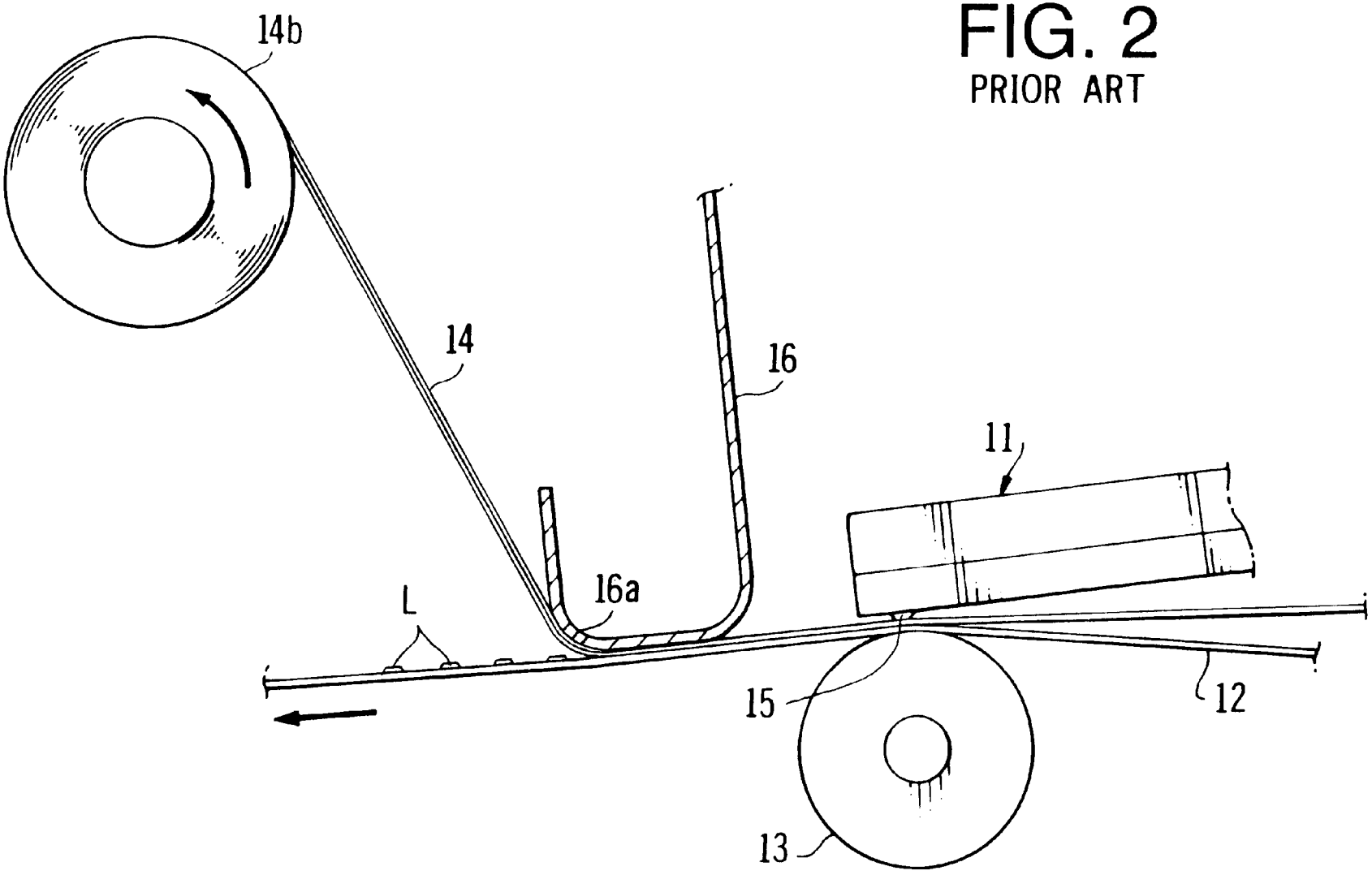
FIG. 2 PRIOR ART
FIG. 2 is a side cross sectional view of a printing region of the conventional thermal transfer printing mechanism.
Figure 3A:
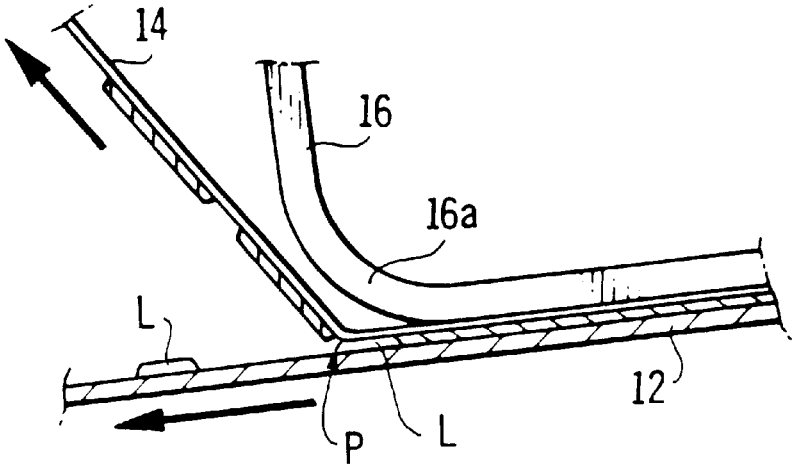
FIG. 3A PRIOR ART
FIGS. 3A and 3B are side cross sectional views of an ink ribbon separating region of the conventional thermal transfer printing mechanism.
Figure 3B:
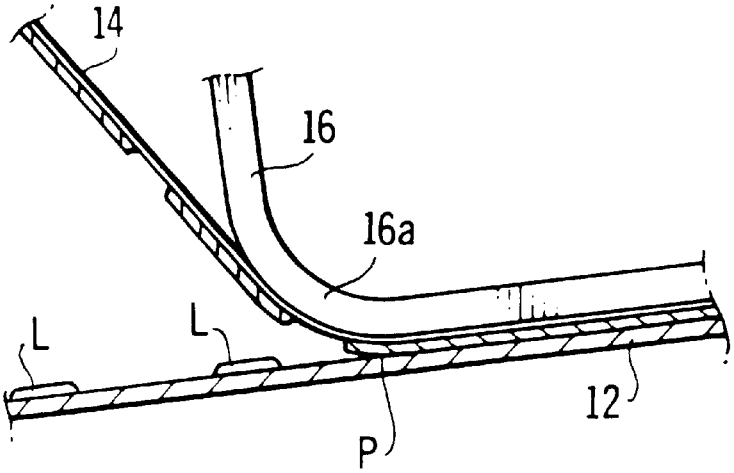
FIG. 3B PRIOR ART
Figure 4:
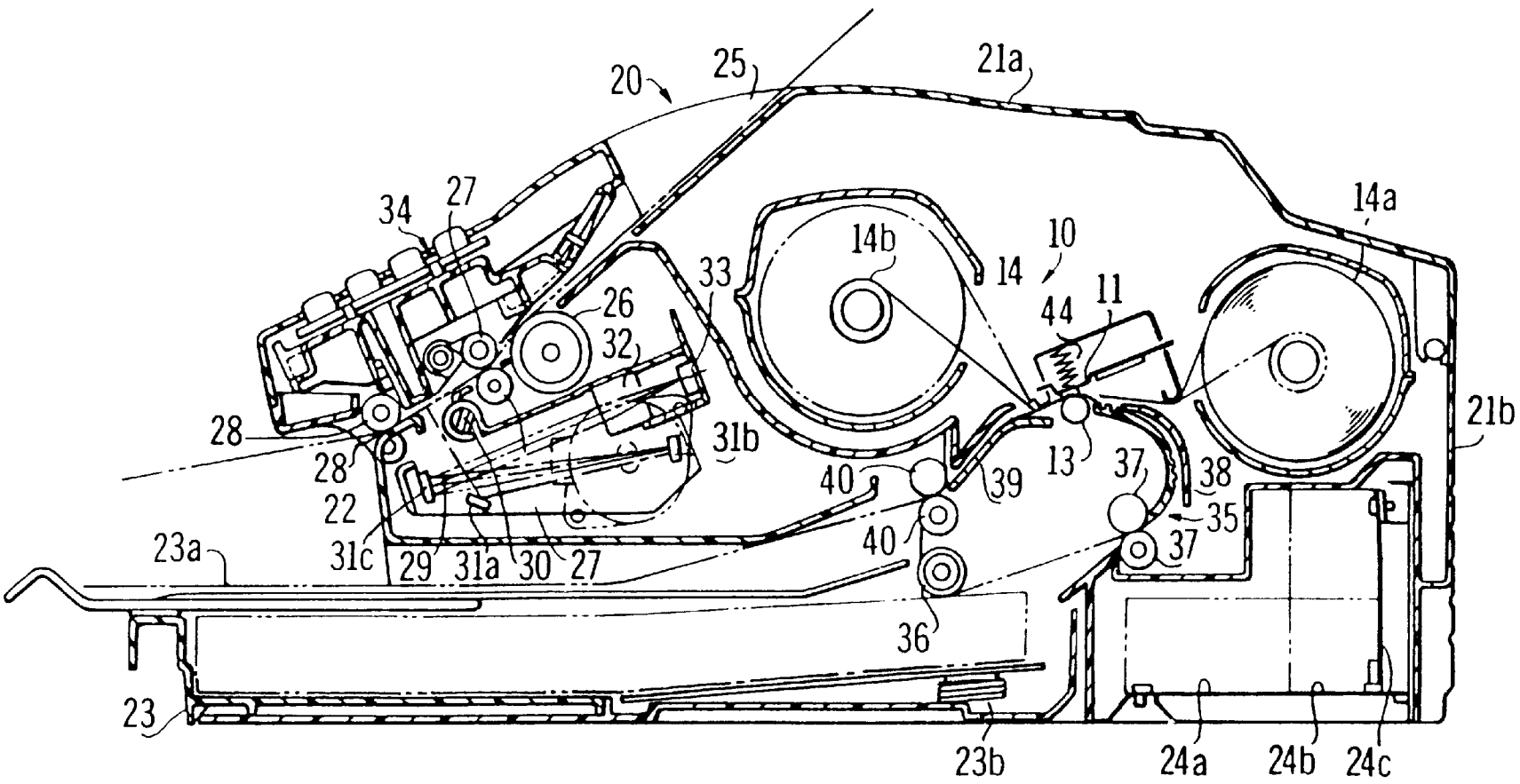
FIG. 4 is a side cross sectional view of a facsimile device incorporating the embodiments of a thermal transfer printing mechanism according to the invention.

FIG. 4 is a side cross-sectional view of a facsimile device 20 using an embodiment of a thermal transfer printing mechanism 10 according to the invention.

A text reading mechanism 22 is provided at the front side (the left side in FIG. 4) of an upper cover 21*a* of the facsimile device 20, and the thermal transfer printing mechanism 10 is provided at the rear side (the right side in FIG. 4) of the facsimile device 20. A sheet cassette 23 for supplying sheet to the printing mechanism 10 is provided in the front side of a lower cover 21*b*. Furthermore, circuit boards 24*a*, 24*b*, and 24*c*, bearing electrical components, are placed in the lower cover 21*b*.

The text reading mechanism 22 includes a separating roller 26 that separates and feeds original sheets from the original stack set on a text plate 25 to a transparent plate 29. The original sheets are fed forward on the transparent plate 29 by a pair of feeding rollers 27, 27. A light source 30 emits light toward the text image on the original sheet, and the reflected light is read by a reading element 33 (for example, a charge coupled device or the like) via mirrors 31*a*, 31*b*, and 31*c*, and a lens 32.

A sheet feeding mechanism 35 includes: a first feeding roller 36 for feeding the uppermost sheet of a stack in the sheet cassette 23; a pair of second feeding rollers 37, 37 for advancing the sheet fed by the first feeding roller 36; a first guide wall 38 for guiding the sheet upward from the second feeding rollers 37, 37; a platen roller 13 for supporting the sheet against the thermal head 11; a second guide wall 39 for curving the sheet feeding path down from the platen roller 13; and a pair of discharge rollers 40, 40 for discharging the sheet to a cover 23*a* of the cassette 23.

Figure 5:
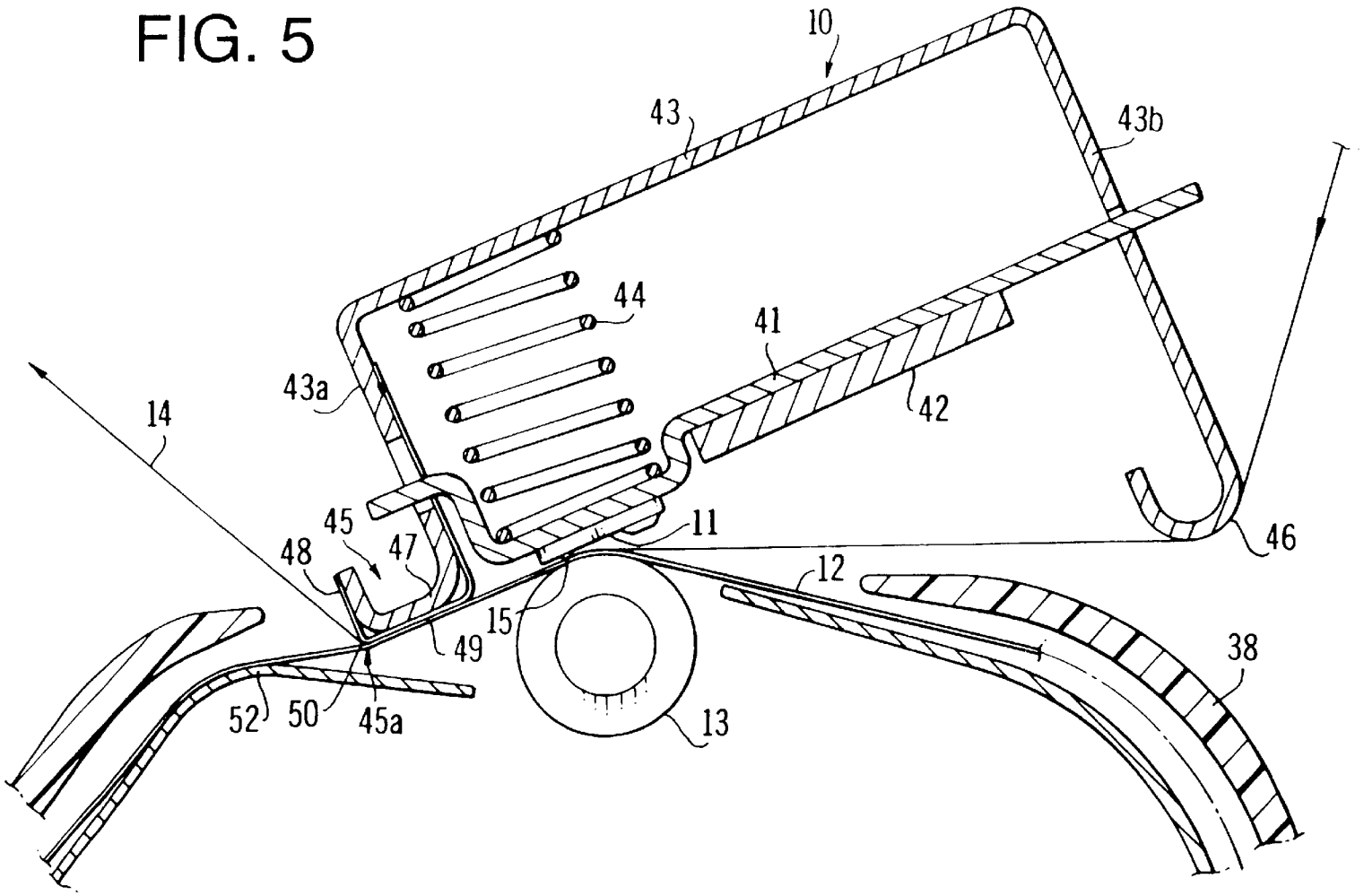
FIG. 5 is a side cross sectional view of a printing region of the facsimile device incorporating the embodiments of a thermal transfer printing mechanism.

As shown in FIG. 5, the thermal head 11 is supported by a support plate 41 that is made of metal and acts to diffuse heat. A heating array 15 is fixed to the lower side of the thermal head 11, and a circuit board 42 is attached to the lower side of the support plate 41. The support plate 41 is swingably supported by a bracket 43, and is biased toward the platen roller 13 by the spring 44. The bracket 43 includes a front wall 43*a*, on which a separating guide 45*a* is formed, and a rear wall 43*b*. A guide 46, for introducing the ink ribbon 14 between the thermal head 11 and platen roller 13 at a certain angle, is formed in lower end of the rear wall 43*b*.

The thermal head 11 extends across the width of sheet 12, and includes a multiplicity of heating elements (not shown) arranged in the heating array 15 in the direction of sheet width. The ink ribbon 14 also has a width corresponding to the width of the sheet 12. A ribbon roller (shown in FIG. 4) is provided for feeding the ink ribbon 14, and a ribbon winding roller (shown in FIG. 4) is provided in front of the bracket 43 for winding the used ink ribbon.

Figure 7:
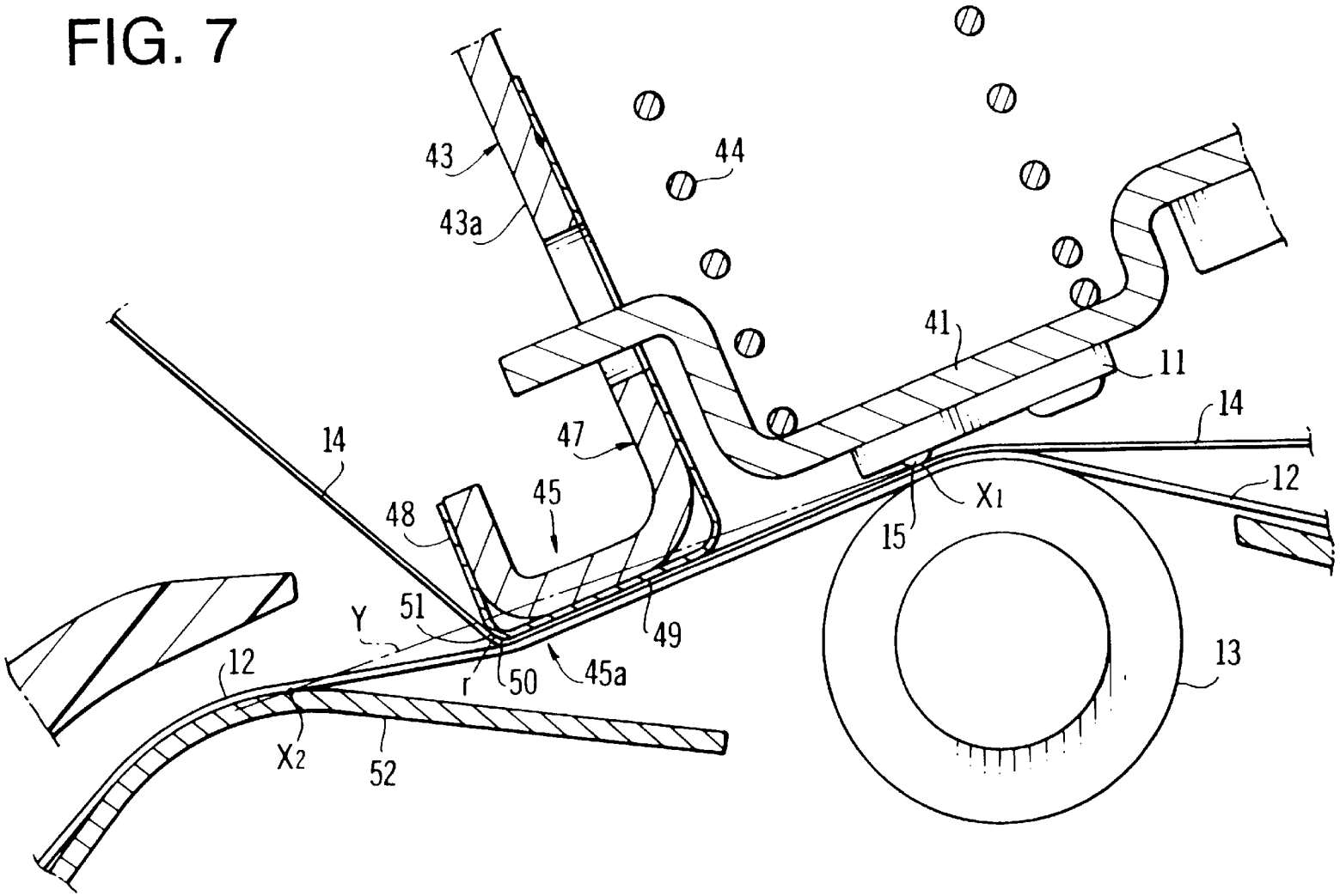
FIG. 7 is a side cross sectional view of the printing region of the facsimile device, incorporating the guide member of FIG. 6.

As shown in FIG. 7, a bent portion 47 at the lower end of the front wall 43*a* of the bracket 43 is bent by a press to be substantially J-shaped. In general, since the bracket 43 is made of metal having sufficient thickness for keeping its strength, the minimum radius of the bent portion 47 should be more than 1.5 mm.

Figure 6:
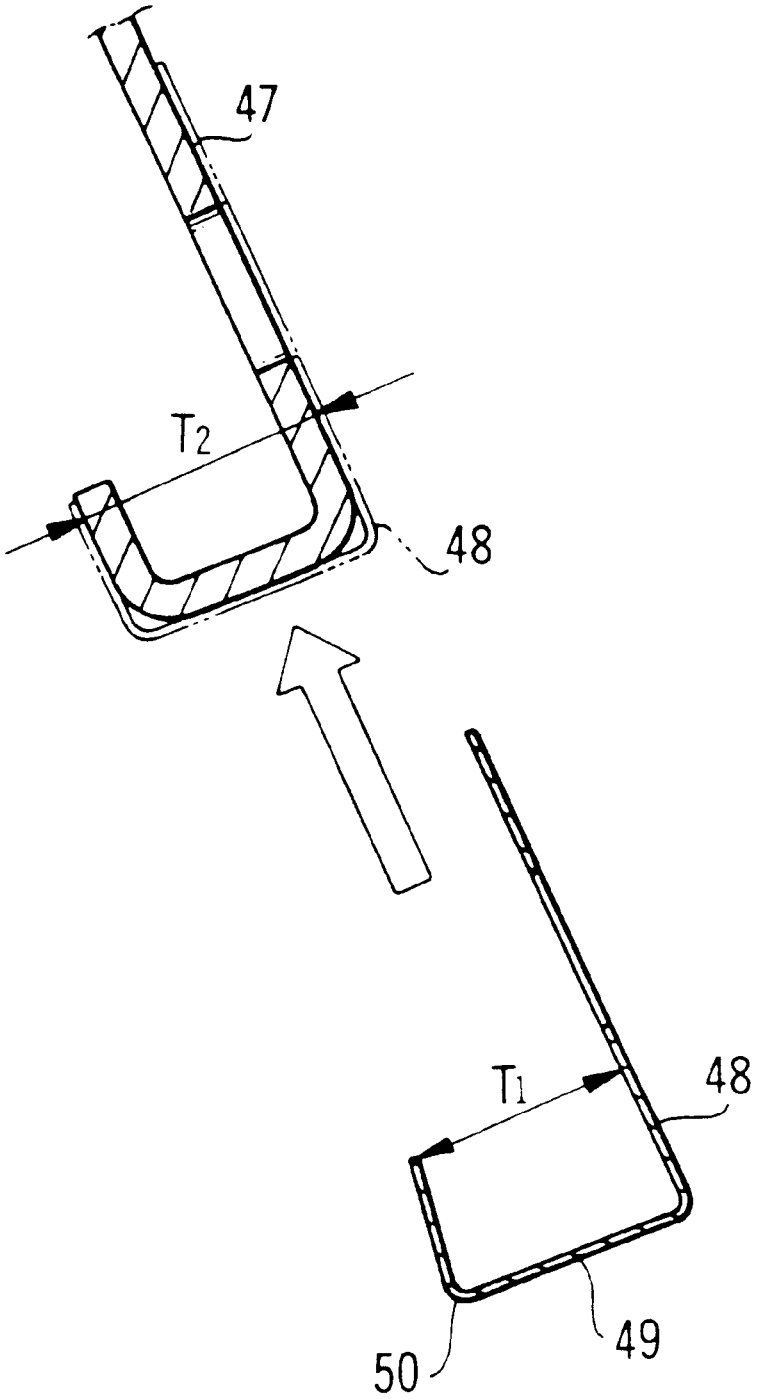
FIG. 6 is a side cross sectional view of a guide member according to a first embodiment of the thermal transfer printing mechanism.

In a first embodiment of a thermal transfer printing mechanism according to the invention, a guide member 48 made of a thin stainless plate of approximately 0.2 mm thickness is provided to the bent portion 47. The outer radius of curvature of a curve 50 of the guide member 48 is not more than than 1.2 mm, and is preferably in the range from 0.4 mm to 1.0 mm. As shown in FIG. 6, the width T1 of a mouth portion of the guide member 48 is formed to be less than the length of the bent portion 47 in the sheet feeding direction. Consequently, when assembled to the bent portion 47, the guide member 48 is clipped to (i.e., elastically couples with) the bent portion 47, and then is spot-welded to the front wall 43*a* only of the bent portion 47. Therefore, the number of positions to be welded is small, making assembly simple.

As shown in FIG. 7, the guide member 48 has a feeding guide surface 49 extending in the feeding direction of the sheet 12 and the ink ribbon 14. The curve 50 is formed as a portion of a separating guide surface 51, and the feeding guide surface 49 merges into the curve 50. The feeding guide surface 49 and separating guide surface 51 (including the curve 50) form a separating guide 45*a*. A concave sheet guide 52 is provided in front of the separating guide 45*a* in the feeding direction. The sheet guide 52 and the separating guide 45*a* form a separating device 45.

The position of the feeding guide surface 49 is beneath a plane connecting a contact line X1 of the thermal head 11 and the ribbon 14, and a contact line X2 of the sheet guide 52 and the sheet 12. Accordingly, the sheet 12 and the ink ribbon 14 are bent and biased by a predetermined amount from this plane.

In operation, after the sheet 12 and the ink ribbon 14 are heated by the thermal head 11, the sheet 12 and the ink ribbon 14 are fed along the feeding guide surface 49. As the ink ribbon 14 is under tension from the ribbon winding roller 14*b,* the ink ribbon 14 is bent along the curve 50 of the separating guide surface 51. Since the radius of curvature of the curve 50 is small, the acceleration of the movement of the ink ribbon 14 in the separating direction is larger than in the conventional mechanism. Consequently, even if the ink ribbon 14 sticks to the sheet 12 due to melting and melted ink, the ink ribbon 12 and sheet 12 are smoothly separated because of the large separating force. Even when lateral lines L are printed, vibration and noise generated by the separation of the ink ribbon 14 from the sheet 12 is prevented.

Experimental results, using an ink ribbon having a thickness of several $\mu$m, have shown that if the radius of curvature of the curve 50 leading into the separating guide surface 51 is not more than 1.2 mm, the generated noise is reduced. Furthermore, if the radius of curvature of the curve 50 is not more than 1.0 mm, the generated noise is further reduced. However, if the radius of curvature of the curve 50 is less than 0.4 mm, the ink ribbon 14 becomes wrinkled. Accordingly, the radius of curvature of the curve 50 should be not less than 0.4 mm.

Figure 8:
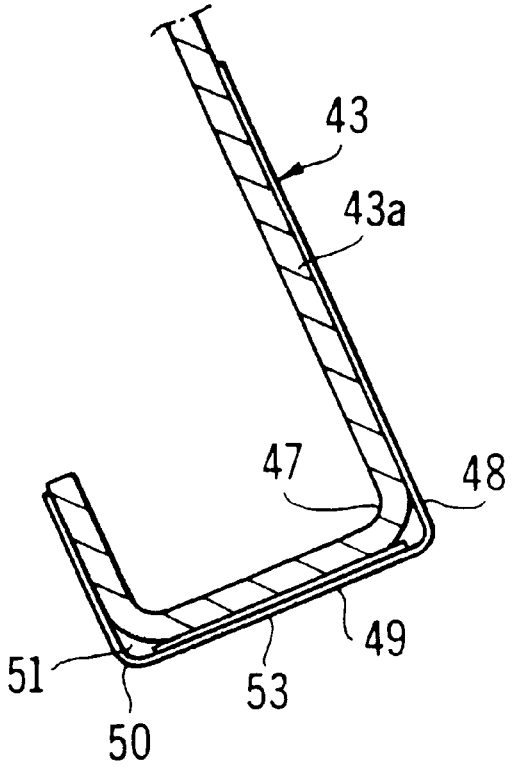
FIG. 8 is a side cross sectional view of a guide member according to a second embodiment of the thermal transfer printing mechanism.

According to a second embodiment of a thermal transfer printing mechanism according to the invention, an adhesive double-sided tape is used to adhere the guide member 48 to the bent portion 47. As shown in FIG. 8, the guide member 48 of the second embodiment (having the same structure as the first embodiment) is clipped to the bent portion 47 as in the first embodiment, and is then secured to the bent portion 47 of the bracket 43 using an adhesive double-sided tape 53. Therefore, the second embodiment requires no welding step, simplifying assembly.

Figure 9:
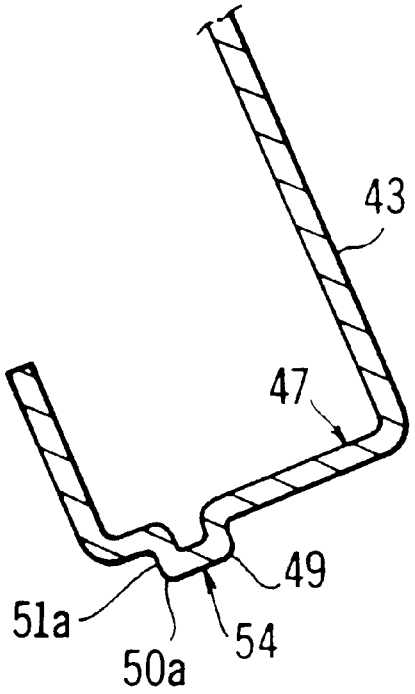
FIG. 9 is a side cross sectional view of a guide member according to a third embodiment of the thermal transfer printing mechanism.

According to a third embodiment of a thermal transfer printing mechanism according to the invention, a concave portion acts to provide a small radius guide, taking the place of the guide member 48 of the first and second embodiments. As shown in FIG. 9, according to the third embodiment, a concave portion 54 is embossed in the bent portion 47. The embossing process plastically deforms the bent portion 47 to form a separating guide surface 51*a* having a small radius (as previously described) curve 50*a* . Accordingly, the number of parts is low, reducing the cost of the printing mechanism.

Figure 10:
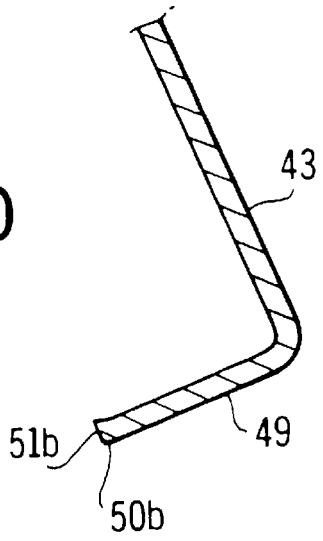
FIG. 10 is a side cross sectional view of a guide member according to a fourth embodiment of the thermal transfer printing mechanism.

According to a fourth embodiment of a thermal transfer printing mechanism according to the invention, the tip of the bent portion 47 is deformed. That is, the most downstream edge of the bent portion 47 is deformed to form a separating guide surface 51*b.* As shown in FIG. 10, in the fourth embodiment, the bent portion 47 is made substantially L-shaped, and a separating guide surface 51*b,* having a small radius (as previously described) curve 50*b* is obtained by deforming the tip of the bent portion 47. Again, the number of parts is low, reducing the cost of the printing mechanism.

Figure 11:
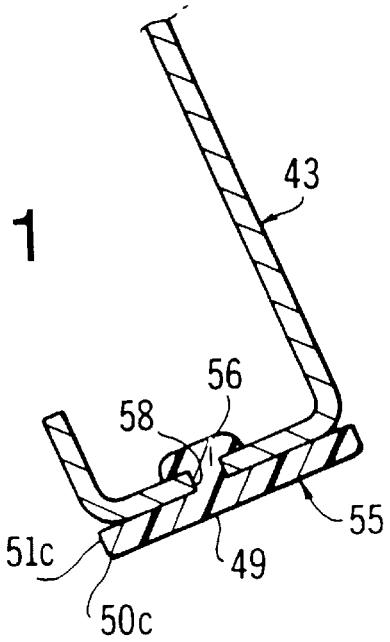
FIG. 11 is a side cross sectional view of a guide member according to a fifth embodiment of the thermal transfer printing mechanism.

According to a fifth embodiment of a thermal transfer printing mechanism according to the invention, a plastic plate 55 is attached to the bent portion 47. As shown in FIG. 11, in the fifth embodiment, a resin plastic plate 55 is formed with a separating guide surface 51*c* having a small radius (as previously described) curve 50*c*. The resin plastic plate 55 is also formed with a projection 56 for inserting into a hole 58 formed on the bent portion 47. After inserting the projection 56 into the hole 58, the tip of the projection 56 is heated and deformed, so that the resin plastic plate 55 is secured to the bent portion 47. Since the separating guide surface 51*c* is formed from resin plastic, the surface can be smoother than an equivalent formed from metal. Therefore, friction and resistance to sliding is reduced, allowing smooth ribbon feeding.

Figure 12:
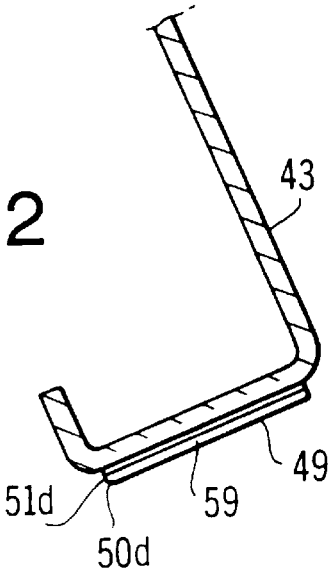
FIG. 12 is a side cross sectional view of a guide member according to a sixth embodiment of the thermal transfer printing mechanism.

According to a sixth embodiment of a thermal transfer printing mechanism according to the invention, a resin plastic tape 59 is used to provide the small radius curve of the separating guide surface. As shown in FIG. 12, in the sixth embodiment, a resin plastic tape 59 is adhered to the lower surface of the bent portion 47. The edge of the resin plastic tape 59 is already formed with a small radius (as previously described) curve 50*d* before being adhered, and the small radius curve 50*d* entirely or almost entirely constitutes a separating guide surface 51*d.* According to this embodiment, the structure is simple and the assembly easy.

What is claimed is:

1. A thermal transfer printing mechanism for forming an image on an image receiving sheet using an ink ribbon, comprising:

a thermal line print head arranged along a sheet feeding path;

a platen roller for pressing the ink ribbon and the image receiving sheet together and against said thermal line print head;

a feeding guide surface downstream of said thermal line printhead along said sheet feeding path, for contacting a surface of the ink ribbon and guiding the ink ribbon; and a separating guide surface downstream of said feeding guide surface along said sheet feeding path, for separating the ink ribbon from the image receiving sheet, said separating guide surface formed as a curve continuing from said feeding guide surface and having a radius of curvature of not more than 1.2 mm;

a supporting member that supports said separating guide surface, wherein said separating guide surface is formed as a bend in a resilient plate, said resilient plate having a thickness of approximately 0.2 mm, and said resilient plate being bent to have a mouth portion formed therein, a width of said mouth portion being smaller than a length of said supporting member in a feeding direction of said sheet feeding path.

2. The thermal transfer printing mechanism according to claim 1, wherein said separating guide surface is formed as a curve having a radius of curvature from 0.4 mm to 1.0 mm.

3. The thermal transfer printing mechanism according to claim 1, further comprising a sheet guide member provided downstream of said separating guide surface and contacting the image receiving sheet, and wherein said feeding guide surface bends said sheet and the ink ribbon from a plane connecting a contact line of said thermal head and the ink ribbon and a contact line of said sheet guide member and said sheet.

4. The thermal transfer printing mechanism according to claim 1, said resilient plate being clipped to said supporting member via said mouth portion and spot welded to said supporting member.

5. The thermal transfer printing mechanism according to claim 1, said resilient plate being clipped to said supporting member via said mouth portion and adhered to said supporting member via double-sided adhesive tape.

6. A thermal transfer printing mechanism for forming an image on an image receiving sheet using an ink ribbon, comprising:

a thermal line print head arranged along a sheet feeding path;

a platen roller for pressing the ink ribbon and the image receiving sheet together and against said thermal line print head;

a feeding guide surface downstream of said thermal line printhead along said sheet feeding path, for contacting a surface of the ink ribbon and guiding the ink ribbon; and a separating guide surface downstream of said feeding guide, surface along said sheet feeding path, for separating the ink ribbon from the image receiving sheet, said separating guide surface formed as a curve continuing from said feeding guide surface and having a radius of curvature of not more than 1.2 mm:

a supporting member on which said separating guide surface is formed, wherein said separating guide surface is formed as an embossed portion of said supporting member.

7. A thermal transfer printing mechanism for forming an image on an image receiving sheet using an ink ribbon, comprising:

a thermal line print head arranged along a sheet feeding path;

a platen roller for pressing the ink ribbon and the image receiving sheet together and against said thermal line print head;

a feeding guide surface downstream of said thermal line printhead along said sheet feeding path, for contacting a surface of the ink ribbon and guiding the ink ribbon; and a separating guide surface downstream of said feeding guide surface along said sheet feeding path, for separating the ink ribbon from the image receiving sheet, said separating guide surface formed as a curve continuing from said feeding guide surface and having a radius of curvature of not more than 1.2 mm;

a supporting member on which said separating guide surface is formed, wherein said separating guide surface is formed as a deformed edge of said supporting member at the most downstream portion of said supporting member.

8. A thermal transfer printing mechanism for forming an image on an image receiving sheet using an ink ribbon, comprising:

a thermal line print head arranged along a sheet feeding path;

a platen roller for pressing the ink ribbon and the image receiving sheet together and against said thermal line print head;

a feeding guide surface downstream of said thermal line printhead along said sheet feeding path, for contacting a surface of the ink ribbon and guiding the ink ribbon; and a separating guide surface downstream of said feeding guide, surface along said sheet feeding path, for separating the ink ribbon from the image receiving sheet, said separating guide surface formed as a curve continuing from said feeding guide surface and having a radius of curvature of not more than 1.2 mm;

a supporting member that supports said separating guide surface, wherein said separating guide surface is formed as a resin plastic plate secured to said supporting member.

9. A thermal transfer printing mechanism for forming an image on an image receiving sheet using an ink ribbon, comprising:

a thermal line print head arranged along a sheet feeding path;

a platen roller for pressing the ink ribbon and the image receiving sheet together and against said thermal line print head;

a feeding guide surface downstream of said thermal line printhead along said sheet feeding path, for contacting a surface of the ink ribbon and guiding the ink ribbon; and a separating guide surface downstream of said feeding guide, surface along said sheet feeding path, for separating the ink ribbon from the image receiving sheet, said separating guide surface formed as a curve continuing from said feeding guide surface and having a radius of curvature of not more than 1.2 mm;

a supporting member that supports said separating guide surface, wherein said separating guide surface is formed as a resin plastic tape adhered to said supporting member.

10. A facsimile device having an image reading apparatus and an image forming apparatus for forming an image on an image receiving sheet using an ink ribbon, said facsimile device comprising:

a thermal transfer printing mechanism, including:

a thermal line print head arranged along a sheet feeding path;

a platen roller for pressing the ink ribbon and the image receiving sheet together and against said thermal line print head;

a feeding guide surface downstream of said thermal line printhead along said sheet feeding path, for contacting a surface of the ink ribbon and guiding the ink ribbon; and a separating guide surface downstream of said feeding guide surface along said sheet feeding path, for separating the ink ribbon from the image receiving sheet, said separating guide surface formed as a curve continuing from said feeding guide surface and having a radius of curvature of not more than 1.2 mm;

a supporting member that supports said separating guide surface, wherein said separating guide surface is formed as a bend in a resilient plate, said resilient plate having a thickness of approximately 0.2 mm, and said resilient plate being bent to have a, mouth portion formed therein, a width of said mouth portion being smaller than a length of said supporting member in a feeding direction of said sheet feeding path.

11. The facsimile device according to claim 10, wherein said separating guide surface is formed as a curve having a radius of curvature from 0.4 mm to 1.0 mm.

12. The facsimile device according to claim 10, said thermal transfer mechanism further comprising a sheet guide member provided downstream of said separating guide surface and contacting the image receiving sheet, and wherein said feeding guide surface bends said sheet and the ink ribbon from a plane connecting a contact line of said thermal head and the ink ribbon and a contact line of said sheet guide member and said sheet.

13. The facsimile device according to claim 10, said resilient plate being clipped to said supporting member via said mouth portion and spot welded to said supporting member.

14. The facsimile device according to claim 10, said resilient plate being clipped to said supporting member via said mouth portion and adhered to said supporting member via double-sided adhesive tape.

15. A facsimile device having an image reading apparatus and an image forming apparatus for forming an image on an image receiving sheet using an ink ribbon, said facsimile device comprising:

a thermal transfer printing mechanism, including:

a thermal line print head arranged along a sheet feeding path;

a platen roller for pressing the ink ribbon and the image receiving sheet together and against said thermal line print head;

a feeding guide surface downstream of said thermal line printhead along said sheet feeding path, for contacting a surface of the ink ribbon and guiding the ink ribbon; and a separating guide surface downstream of said feeding guide surface along said sheet feeding path, for separating the ink ribbon from the image receiving sheet, said separating guide surface formed as a curve continuing from said feeding guide surface and having a radius of curvature of not more than 1.2 mm;

said thermal transfer mechanism further comprising a supporting member on which said separating guide surface is formed, wherein said separating guide surface is formed as an embossed portion of said supporting member.

16. A facsimile device having an image reading apparatus and an image forming apparatus for forming an image on an image receiving sheet using an ink ribbon, said facsimile device comprising:

a thermal transfer printing mechanism, including:

a thermal line print head arranged along a sheet feeding path;

a platen roller for pressing the ink ribbon and the image receiving sheet together and against said thermal line print head;

a feeding guide surface downstream of said thermal line printhead along said sheet feeding path, for contacting a surface of the ink ribbon and guiding the ink ribbon; and a separating guide surface downstream of said feeding guide surface along said sheet feeding path for separating the ink ribbon from the image receiving sheet, said separating guide surface formed as a curve continuing from said feeding guide surface and having a radius of curvature of not more than 1.2 mm;

said thermal transfer mechanism further comprising a supporting member on which said separating guide surface is formed, wherein said separating guide surface is formed as a deformed edge of said supporting member at the most downstream portion of said supporting member.

17. A facsimile device having an image reading apparatus and an image forming apparatus for forming an image on an image receiving sheet using an ink ribbon, said facsimile device comprising:

a thermal transfer printing mechanism, including:

a thermal line print head arranged along a sheet feeding path;

a platen roller for pressing the ink ribbon and the image receiving sheet-, together and against said thermal line print head;

a feeding guide surface downstream of said thermal line printhead along said sheet feeding path, for contacting a surface of the ink ribbon and guiding the ink ribbon; and a separating guide surface downstream of said feeding guide surface along said sheet feeding path, for separating the ink ribbon from the image receiving sheet, said separating guide surface formed as a curve continuing from said feeding guide surface and having a radius of curvature of not more than 1.2 mm;

said thermal transfer mechanism further comprising a supporting member that supports said separating guide surface, wherein said separating guide surface is formed as a resin plastic plate secured to said supporting member.

18. A facsimile device having an image reading apparatus and an image forming apparatus for forming an image on an image receiving sheet using an ink ribbon, said facsimile device comprising:

a thermal transfer printing mechanism, including:

a thermal line print head arranged along a sheet feeding path;

a platen roller for pressing the ink ribbon and the image receiving sheet-, together and against said thermal line print head;

a feeding guide surface downstream of said thermal line printhead along said sheet feeding path, for contacting a surface of the ink ribbon and guiding the ink ribbon; and a separating guide surface downstream of said feeding guide surface along said sheet feeding path, for separating the ink ribbon from the image receiving sheet, said separating guide surface formed as a curve continuing from said feeding guide surface and having a radius of curvature of not more than 1.2 mm;

said thermal transfer mechanism further comprising a supporting member that supports said separating guide surface, wherein said separating guide surface is formed as a resin plastic tape adhered to said supporting member.

* * * * *